United States Patent [19]

Klein

[11] 4,125,204

[45] Nov. 14, 1978

[54] GATED CAN END WITH SHEAR OFFSET DEFINING GATE

[76] Inventor: Gerald B. Klein, 13451 Stuart Ct., Broomfield, Colo. 80020

[21] Appl. No.: 821,625

[22] Filed: Aug. 4, 1977

Related U.S. Application Data

[60] Division of Ser. No. 774,596, Mar. 7, 1977, which is a continuation-in-part of Ser. No. 625,716, Oct. 24, 1975, Pat. No. 4,018,178.

[51] Int. Cl.[2] ..... B65D 41/32

[52] U.S. Cl. ..... 220/268

[58] Field of Search ..... 220/265–273, 220/90.6; 113/121 C

[56] References Cited

U.S. PATENT DOCUMENTS

| | | | |
|---|---|---|---|
| 3,880,316 | 4/1975 | Martella | 220/268 |
| 3,980,200 | 9/1976 | Klein | 220/268 |

*Primary Examiner*—George T. Hall

*Attorney, Agent, or Firm*—Dennis O. Kraft

[57] ABSTRACT

A can end includes a pushdown gate formed in a panel portion below a narrow, underfolded rim at the opening in the end. The outline of the gate is a frangible discontinuity in the panel portion underneath the rim and the same may be ruptured by pushing the gate downwardly and into the can. A method of drawing and folding the end material permits the frangible discontinuity to be formed before the rim is folded over the discontinuity.

4 Claims, 13 Drawing Figures

GATED CAN END WITH SHEAR OFFSET DEFINING GATE

This is a division of application Ser. No. 774,596, filed Mar. 7, 1977; and which is a continuation-in-part of Ser. No. 625,716, filed Oct. 24, 1975, now U.S. Pat. No. 4,018,178.

The present invention relates to can ends having a gate which may be opened by pushing the gate downwardly into the can, of the type sometimes called a triple-fold gate, such as disclosed in the patent issued to Kenneth E. Harper and myself, U.S. Pat. No. 3,334,775, on Aug. 8, 1967, and more particularly to a gated can end where the gate is defined by a frangible discontinuity in the end panel. This frangible discontinuity is ruptured when the gate is pushed downwardly and into the can. The invention relates further to providing improved modes for producing frangible discontinuities as will hereinafter appear.

A can end having a push-in gate, or tab, defined by a score line or cut in the surface of the end, was found to be undesirable because of the sharp, ragged edge formed about the opening when the gate was separated from the end. This edge could easily cut an individual's finger as he opened the gate and even cut his lips when drinking from the can. As a result, an improved type of a push-in gate for a can end was invented and developed as disclosed in aforementioned U.S. Pat. No. 3,334,775. This patent discloses a narrow, underfolded rim about an opening, or aperture, in the can end with the gate being in a panel below this rim and being defined by a score line which underlies this rim. The construction is commonly called a "triple-fold gate".

This arrangement may be manufactured by conventional drawing methods where the metal forming the can end is first stretched to form a cup-like cavity which defines the aperture. Thereafter, the walls of the cup-like cavity are further stretched to form the intermediate underfolded rim and to enlarge the area of the end portion forming the panel. As a final step, a score line is cut at the underside of this panel, underneath the intermediate rim, to define the gate. Accordingly, whenever the gate is opened by pushing it into the can, the edge of the opening, the aperture, is the rounded edge of metal joining the end and the intermediate rim and not the torn edge at the score line. The rounded edge at the opening, or aperture, eliminates the possibility of an individual cutting his finger in the opening.

In the manufacture of a gated can end as disclosed in the U.S. Pat. No. 3,334,775, it becomes necessary to use very precise dies and careful operations to form the opening and to cut the score line to form this triple-fold gate. If the dies are not precise, too deep a cut can cause the score line to accidentally rupture and too shallow a cut will require an excessive pushing force to tear the score line. If the metal plate of the can end varies in thickness, the cutting against the underfolded rim makes precision tooling even more important.

In the manufacture of more common types of gated can ends, having a surface without an underfolded rim, it was found that frangible discontinuities, other than a score line cut, could be used. For example, a partial shear offset to outline the gate was effective. Also, with some types of metal, frangible discontinuities other than a score line cut can be used. However, the frangible discontinuities herein considered cannot be formed in the panel portion underneath the intermediate rim of a triple-fold gate using conventional forming and drawing operations.

As disclosed in U.S. Pat. No. 4,019,178, it was positioned that if a score line outlining the gate could be formed at the upper surface of the panel portion of the can end, instead of at the undersurface of the underfolded panel, the result would be desirable for several reasons. In the first place, this might eliminate a need to repair the protective coating at the underside of the can end. Also, since the score line could be cut with the dies operating against a single thickness of the metal, rather than three thicknesses, a much better control of the depth of the score line or cuts would be possible and the panel could even be coined to obtain better precision. However, when considering conventional drawing procedures, it becomes apparent that the placement of a score line at the upper surface of the can end and underneath the intermediate rim is physically impossible. It is axiomatic that a score line so positioned to define the gate, must be cut before the drawing operations to form the intermediate underfold rim are completed, because the underfolded rim will lie over this score line or cut. Since any drawing operation involves stretching of metal, a smooth surfaced sheet is necessary, and even a slight scratch in the sheet being drawn may cause the metal to tear as the drawing proceeds.

Thus, a line cannot be cut in the end as an intermediate step of the drawing operations, such as after the metal forming the can end is stretched to form a cup-like cavity but before the cavity is further stretched to form the intermediate underfolded rim beneath the end because the metal will rupture at the score line.

Precisely the same objections and difficulties of manufacture, as outlined above, can be directed to other frangible discontinuities hereinafter disclosed, such as a partial offset shear outlining the gate in the panel beneath the underfolded rim.

The present invention was conceived and developed with the above considerations in view and comprises, in essence, a triple-fold gate for a can end, formed in a panel beneath an underfolded, intermediate, compressively-formed rim about an opening or aperture in the end, and wherein the outline of this gate is defined by a frangible discontinuity such as a partial shear offset which lies beneath the intermediate rim. This invention is concerned with frangible discontinuities including a partial shear offset and also a shear offset which is returned towards, to, or beyond the initial panel plane, an operation which will be hereinafter called a "replaced offset"; closely adjacent score cuts from opposite sides of the panel to produce a thin web or residual between them, hereinafter called a "disruptible residual"; and two sequentially impressed, opposing scores to work harden and partially shear the disruptible material between the scores, hereinafter called a "compound score".

This invention also includes a method for drawing and shaping the end to produce such a gate, and includes the final steps of compressing, instead of stretching, portions of the sheet metal forming the end after the partial shear offset or shear line defining the gate is formed. It was discovered that the aperture and the underfolded rim could be partially shaped by drawing to upstand about the panel edge, and after a frangible discontinuity outlining the gate was formed in the panel, the shaping of an aperture with an intermediate rim over the discontinuity could be completed by folding the rim inwardly and over the panel.

It follows that an object of the invention is to provide, in a can end having a triple-fold push-in gate, in a panel underlying a narrow, intermediate rim underfolded about an aperture, a frangible discontinuity defining the outline of the gate in the panel and a novel and improved method for producing the same.

Another object of the invention is to provide, in such an arrangement, a simplified method of forming a triple-fold gate in a can end which permits a frangible discontinuity to be struck in the gate panel before the steps of forming the triple-fold are completed.

Another object of the invention is to provide in a can end having a gate panel formed beneath an underfolded rim about an opening in the lid, a frangible discontinuity outlining a gate within the panel which may be cut in a very precise manner, such that the gate can be easily opened, yet will not accidentally open.

Another object of the invention is to provide, in a triple-fold push-in gate, in a panel underlying a narrow intermediate rim underfolded about an aperture, a frangible discontinuity outlining the gate, formed by improved and simplified types of frangible discontinuities including a shear offset, a replaced offset, a disruptible residual and a compound score.

Another object of the invention is to provide a novel and improved mode of providing a frangible discontinuity outlining the gate in the panel of a triple-fold gate of a can end which may be produced in a simple, effective manner.

Another object of the invention is to provide in a triple-fold gate can end having the gate outlined by a frangible discontinuity, a method of forming the triple-fold gate which is economical, reliable and results in a neat appearing, low-cost product.

With the foregoing and other objects in view, my present invention comprises certain constructions, combinations and arrangements, sequences, operations and steps, all as hereinafter described in detail, defined in the appended claims, and supplemented by the accompanying drawing in which:

Figure 1:
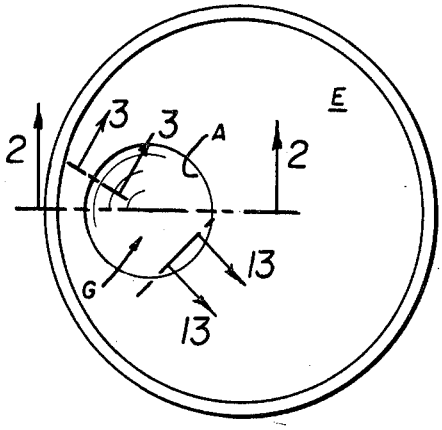
FIG. 1 is a plan view of a can end having a gate formed therein according to the invention.

Referring now to the embodiments illustrated in the drawings, a portion of the can end E is drawn to form a gate G near one edge of the end. The gate G is in a panel portion 20 underneath an aperture A which is connected to the end by a narrow rim R extending about this aperture (see FIGS. 2 and 3). The inner edge 21 of the rim turns upwardly to connect with the end E and the outer edge 22 of the rim turns downwardly to connect with the panel 20 wherein the gate G is located. Such a structure may be conventionally formed by drawing operations to form a cup with the wall of the cup becoming the rim portion R. This may be followed by coining to increase the size of the panel portion 20 at the bottom of the cup and the panel 20 becomes the gate. Thereafter, folding operations to create the fold of the rim under the lid are followed by cutting a score line at the underside of the panel portion to complete the operation. See the U.S. Pat. No. 3,334,775.

In the present invention, the frangible discontinuity will be first described as a shear offset 23, FIGS. 2 to 14, which outlines the gate instead of a score cut. As mentioned, the frangible discontinuity may also be a replaced offset, a disruptible residual or a compound score as will be hereinafter further described. A modified sequence of operations, as hereinafter described, permit the shear offset 23 or other frangible discontinuities, to be pressed in the panel portion 20 forming the gate and be underneath the rim R as illustrated at FIGS. 2, 3 and 7 to 12. The gate G, shown at FIG. 1, is illustrated as being circular to lie underneath a circular aperture A. However, the aperture may also be shaped otherwise, such as to an ovate form without changing the basic structure.

Figure 2:
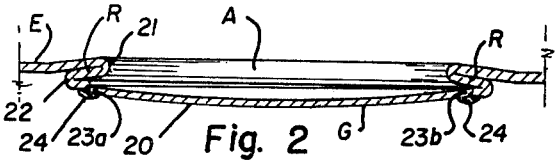
FIG. 2 is a fragmentary sectional detail as taken from the indicated line 2—2 at FIG. 1, but on an enlarged scale and with the thickness of the can end being somewhat exaggerated to better illustrate the construction of the gate and the partial shear offset therein.
Figure 4:
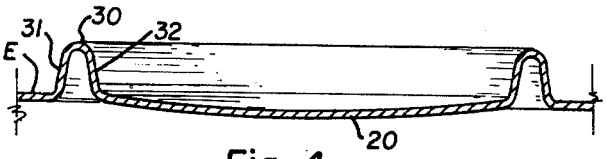
FIGS. 4, 5, 6 and 7 are fragmentary sectional views similar to FIG. 2, but illustrating the principal sequential steps which may occur in the formation of the triple-fold gate construction shown at FIG. 2.
Figure 3:
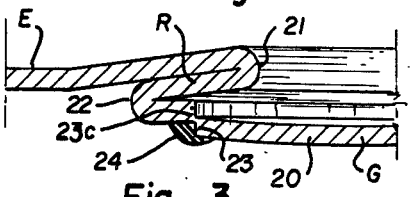
FIG. 3 is a fragmentary sectional detail as taken from the indicated line 3—3 at FIG. 1, but on a greatly enlarged scale and exemplifying the shear offset as extending partially through the panel, and indicating further, the use of a sealant to protect the offset.
Figure 7:
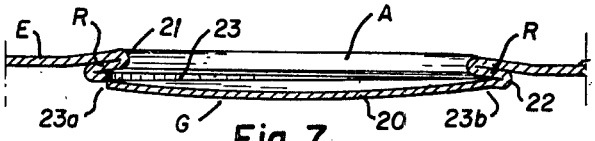
Figure 14:
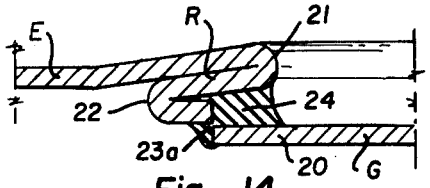
FIG. 14 is a fragmentary sectional detail similar to FIG. 3, but showing the shear offset completely through the panel and sealant at both sides of the panel sealing the opening at the shear offset.
Figure 18:
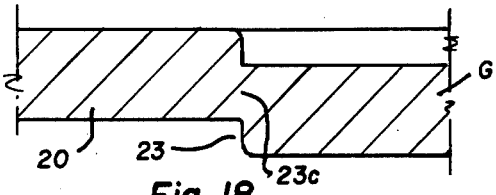
FIG. 18 is a greatly enlarged fragmentary sectional view of the shear offset shown at FIG. 15.

This shear offset 23 which will be pressed into the surface of the lid by a suitable die may vary in depth at different points about its circular reach. Such variations are shown in FIGS. 8 to 12 and 14. Preferably, the gate will commence to open at a point 23*a* near the edge of the can lid and will hinge at a point 23*b* diametrically opposite therefrom as best illustrated at FIGS. 2 and 7. Accordingly, the depth of the offset shear at the opening point 23*a* may extend almost through the lid, or even through the lid, to more easily start the opening operation and more easily continue to shear the lid away from the panel 22 as the gate is pushed away from the panel. The offset shear may also extend completely through the lid at this point, as best illustrated at FIG. 14, and a suitable sealant 24, such as a selected microcrystalline wax, may be used at this point to fill the opening to prevent leakage of the contents of the can. A sealant may be used, even without the shear extending through the panel, and will be applied to the underside of the can end at the shear offset, as 24*a* at FIG. 3. Where the shear offset 23 is only partially through the panel, there will be a narrow neck 23*c* of disrupted metal, as best shown at FIGS. 3 and 18, so the gate will remain integral with the can lid until the gate is pushed downwardly to open the lid. Then the pressure against the disrupted metal, a continued shear action, will sever the gate from the panel. However, at the opposite hinging edge 23*b* of the gate, the shear offset will be shallow or completely absent so that the gate will hinge downwardly into the can of this point without separation from the lid.

Figure 12:
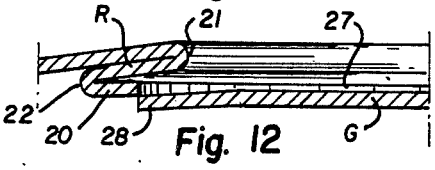
FIG. 12 is a fragmentary sectional detail as taken from the indicated line 12—12 at FIG. 11.
Figure 8:
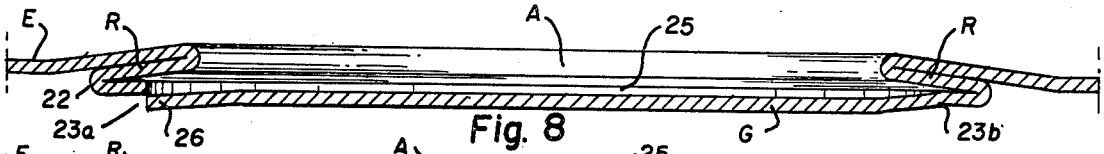
FIGS. 8, 9, 10 and 11 are fragmentary sectional views similar to FIG. 7, but on a further enlarged scale and illustrating different modes of forming a partial shear offset underneath the underfolded rim in accordance with the present invention.
Figure 9:
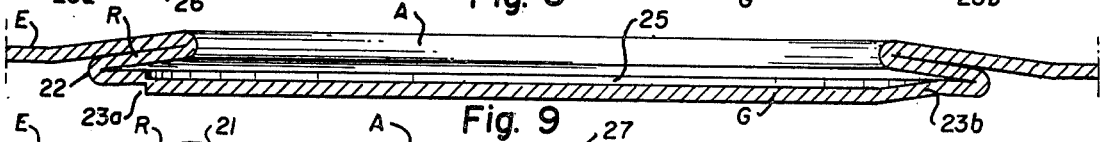
Figure 10:
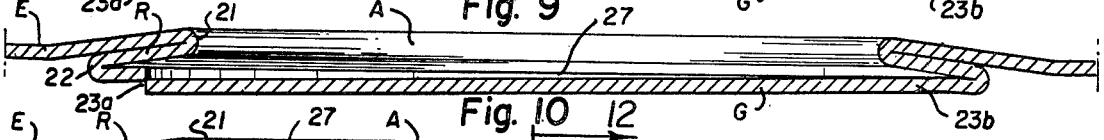
Figure 11:
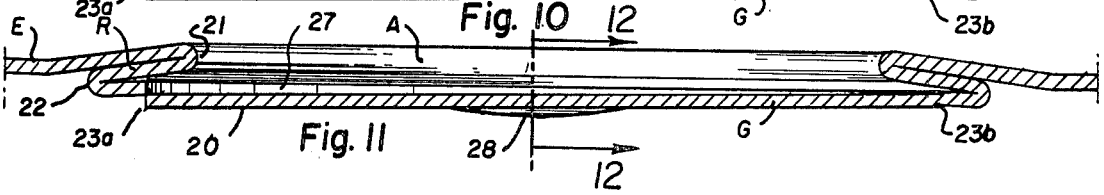

The manner in which the shear offset 23 can be cut can be varied and several such variations are shown at FIGS. 8–11. In FIG. 8, the depth of the offset is shown as being uniform about the gate as at 25, except at the hinge 23*b* and a cut-through portion 26 at the opening point 23*a* to facilitate pushing the gate downwardly from the panel. In FIG. 9, the depth of the offset is uniform at all points about the gate as at 25, excepting the hinge 23*b*. In FIG. 10 the shear tapers, as at 27, are shown from a minimum at the hinge 23*b* to a maximum at the opening point 23*a*. In FIGS. 11 and 12 a tapered shear 27 is shown with multiple cut-through portions 28 at the sides of the taper or at any other desired location.

As shown in the drawings, this shear offset 23 is completely underneath the rim R and away from the inner edge of the aperture A. Thus, any ragged edge of metal which may result when the gate is pushed downwardly and severed at the shear offset, will not be at a position where it can contact a user's finger should his finger be pushed into the aperture while opening the gate. Instead, the rounded inner edge 21 joining the rim to the lid will be contacted. It is to be noted that the panel 20 forming this gate G may be of any desired form. FIGS. 2, 3 and 7 show a concave dish, FIGS. 8 to 11 show a flat surface. Also, the inner portion of the panel forming the gate may be formed as a convex dome of any configuration which is not shown in the drawings.

FIGS. 4–7 illustrate in a somewhat diagrammatic manner some of the steps for forming a gate G underneath the underfolded rim R and with the shear offset 23 being pressed in the panel 20. The first operations will involve metal stretching at the panel area where the gate G is to be located. For example, a hat section or cup, not shown, may be formed and the panel area may be suitably dished to provide an excess of metal to work with. Next, the cup portion of the hat section may be raised to form an upstanding ridge 30 above the surface of the end E and a dished panel portion 20, see FIG. 4.

Figure 5:
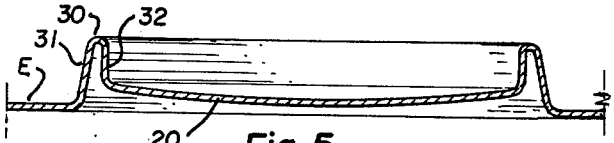
Figure 13:
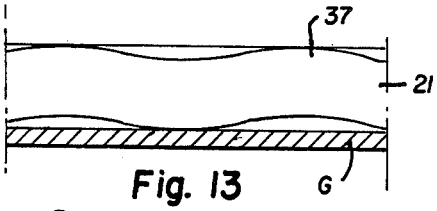
FIG. 13 is a fragmentary sectional detail as taken from the indicated line 13—13 at FIG. 1, but on an enlarged scale and showing, in a somewhat exaggerated manner, a ripple pattern which can form in the overfold of the lid and rim portion above the gate when it is compressed as from the position shown at FIG. 6 to the position shown at FIG. 7.
Figure 6:
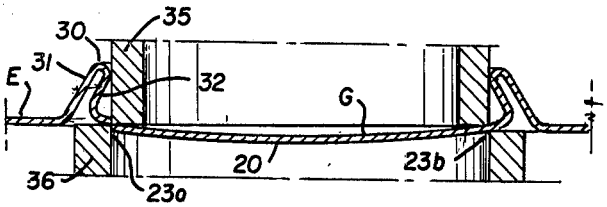

As illustrated at FIG. 5, a further step in the forming operations consists in modifying the shape of the panel 20 to approach its final form. The concavity as shown at FIGS. 5, 6 and 7 may be flat or domed as heretofore mentioned. At the same time, the ridge 30 is narrowed by squeezing in the sides 31 and 32 to permit this ridge to upstand above the end surface as a ring-like form.

The next steps in the forming operations use a compressive die to engage the outer side of the ring-shaped ridge 30 to compress and tip this ring-shaped ridge inwardly as to the position shown at FIG. 6, to commence an inward movement to eventually cause the ridge 30 to overlie the edge of the panel 20 and form the inner edge 21 of the aperture. However, when the circular channel ring is tipped inwardly a small amount, the shear offset 23 is pressed or formed in the panel 20 by dies 35 and 36, above and below the panel, as illustrated at FIG. 6. It is to be noted that this offset shear may not cut the panel 31 uniformly, but that a maximum shear offset may be at the opening point 23*a* and a minimum shear offset may be at the hinge 23*b*. Also, the shear offset in the panel portion 31 is at a location where further flexing and stressing of the metal forming the can lid will not occur when the ridge 30 is tipped over and compressed to form the aperture fold 21.

Further steps to complete the can end with the triple-fold gate therein are performed by compression to fold the channel ridge 30 inwardly and downwardly to complete the forming of the aperture, as illustrated at FIG. 7, so that the aperture and rim R will lie against the circular panel 20. This final operation will result in compressing the channel ring inwardly and downwardly in a manner which is contrary to a conventional drawing operation since the metal in this ring will be compressed instead of being drawn, and the compression will be the only operation occurring after the offset shear 23 is pressed in the panel 22. Furthermore, the compression is in a region away from and not affecting the shear. In compressing a thin metal ring such as is formed in a can end sheet having a thickness of only a few thousandths of an inch, it is possible that the operation will cause the inside edge of the ring to buckle. Nevertheless, under the influence of a properly formed set of dies, such buckling action will be in a comparatively uniform manner as diagrammatically illustrated as a ripple 37 at FIG. 13. This rippling 37 will actually be minimized by the pressure of the dies pushing the circular channel in its final position and even, if noticeable on the final can lid, the ripple will not be objectionable or significant.

Figure 15:
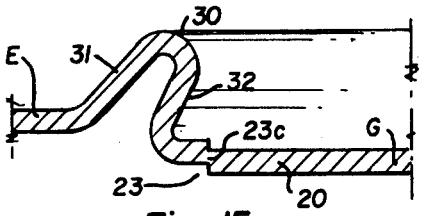
FIG. 15 is a fragmentary sectional view similar to a portion of FIG. 6, but on an enlarged scale and with the gate being defined by a partial shear offset as preparatory to forming a replaced offset.
Figure 16:
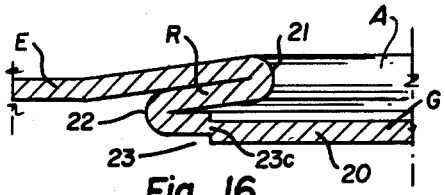
FIG. 16 is a sectional view similar to FIG. 15, but showing the ridge folded downwardly to form the underfold and aperture above the gate.

FIGS. 15 to 19 show another type of frangible discontinuity, a "replaced offset". The aperture A and gate panel 20 are prepared in essentially the same manner as heretofore described, to the point where an offset shear is cut in the panel 20, as at FIG. 6. As shown at FIGS. 15 and 18 the offset shear is cut only partially through the metal and the remaining material 23*c* between the offsets may be more than half the thickness of the metal. Next, the ridge 30 is compressively overfolded to form the aperture A above the gate and inner fold 21, the same as shown at FIG. 7 and heretofore described, and also shown at FIG. 16.

Figure 17:
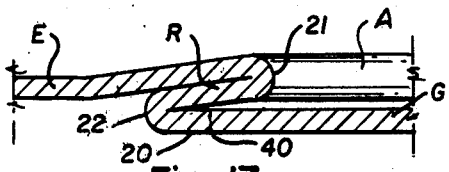
FIG. 17 is a sectional view similar to FIG. 15, but showing the unit finished with the replaced offset being formed by compressing the gate against the underfolded rim.

The final step is to return the offset portion of the panel 20, forming the gate G, towards its original position as illustrated at FIG. 17 to produce the replaced offset 40, essentially a shear offset and a reverse shear offset. This reverse shear offset may bring the gate to the original panel position, or not quite to, or even slightly beyond this original position, as desired.

Figure 19:
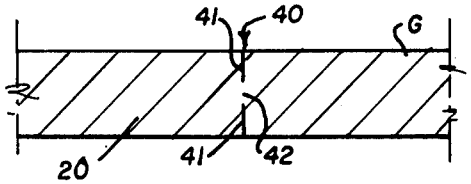
FIG. 19 is a fragmentary sectional view similar to FIG. 18, but showing the return of metal to produce the replaced offset.

FIGS. 18 and 19 illustrate the manner in which this replaced offset 40 is formed. The partial shear offset 23 at FIG. 18 causes metal working between the gate and the outer portion of the panel 20 from which the gate is formed. The reverse action producing the replaced offset 40 produces a partial severance at each side of the metal panel, indicated at 41, and an intense cold working of the remaining neck 42 of connecting metal such that a downward pressure on the gate can easily disrupt this neck 42 and permit the gate G to be pushed into the can. It is to be further noted that while the replaced offset 40, shown at FIG. 19 is illustrated as extending directly through the metal and essentially normal to the surfaces of the metal, this replaced offset can be easily tipped slightly by having a slight separation of the dies forming the initial shear offset and such tipping could be advantageous when properly directed to permit an easy downward thrust as when it becomes desirable to sever the gate from the panel, but which will very effectively resist pressure in the opposite direction as when a can of carbonated beverage is accidentally overheated, the inclined shear line then locking the gate in position.

Figure 20:
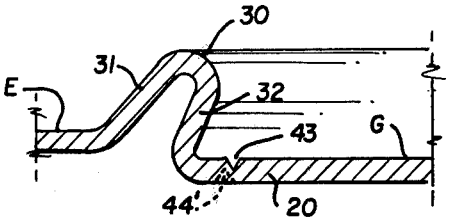
FIG. 20 is a fragmentary sectional view similar to FIG. 15, but with a score cut at the upper surface thereof showing the first step of forming a disruptible residual, the frangible discontinuity outlining the gate, and with broken lines indicating the position of the opposite score cut to produce the residual.
Figure 21:
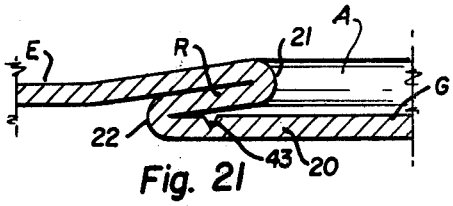
FIG. 21 is a fragmentary sectional view similar to FIG. 20 but with the ridge folded downwardly to form the underfold and aperture.
Figure 22:
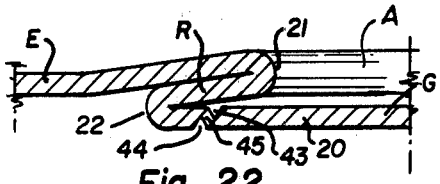
FIG. 22 is a fragmentary sectional view similar to FIG. 21, but with a score cut at the undersurface to complete the disruptible residual.

FIGS. 20 to 25 illustrate the formation of a frangible residual, a narrow neck of metal between two closely adjacent score cuts from opposite sides of the metal panel. The aperture A and the gate panel 20 are prepared as heretofore described, to the point where the gate panel is ready to be cut by a shear, as at FIG. 6. However, instead of a shear offset 23 as heretofore described, a score cut 43 is made at the upper surface of the panel 20 as shown at FIG. 20. Next, the ridge 30 is folded upon the panel to form the aperture A and inner fold 21 as shown at FIG. 21. Next, an adjacent, opposing score cut 44 is made at the under surface of the panel with the frangible residual 45, a narrow neck of metal between the score cuts 43 and 44 being thus formed.

It is to be noted that this residual 45 is intensely worked and will normally be quite frangible and easily ruptured by downward pressure on the gate. The cutting of scores 43 and 44 in the panel will compress the metal of the panel and otherwise place it under stress to further ease the problem of initial rupture.

Figure 23:
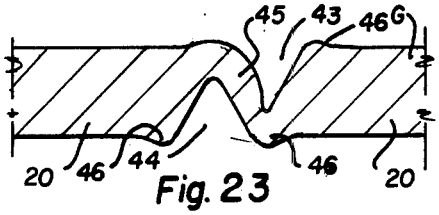
FIG. 23 is a greatly enlarged fragmentary sectional view of the disruptible residual formed according to the step shown at FIGS. 20, 21 and 22.

FIG. 23 is an enlarged view of a residual 45 formed as above described and it is to be noted that when the scores are cut some metal flow will occur at the edges of each score cut, as at 46, and metal will be pushed into the score 43 when the score 44 is subsequently cut.

Figure 24:
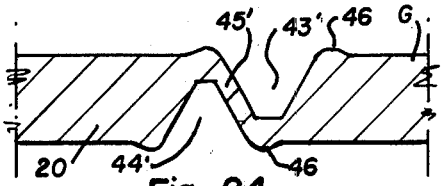
FIG. 24 is a sectional view of a disruptible residual with simultaneous score cuts at opposite sides of the panel.

FIG. 24 illustrates a modified manner in which the scores 43' and 44' are cut to produce a residual 45' of uniform thickness, by the expedient of cutting the score lines simultaneously, the score 44' being located as shown in broken lines at FIG. 20. It is to be noted that metal flow 46 will occur at the edges of the cut, and that the residual 45' will be intensely worked.

Figure 25:
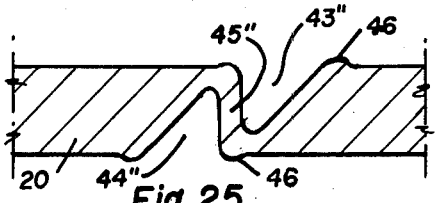
FIG. 25 is a sectional view similar to FIG. 24 but with a disruptible residual of precise thickness.

FIG. 25 illustrates a further modified manner in which the scores 43" and 44" are cut with the wedge-like cutting faces of the score dies being vertical in such a manner as to produce a residual 45" essentially normal to the plane of the panel 20. With this arrangement, the residual 45" will have a very precise thickness even though the thickness of the metal plate forming the panel will vary.

Figure 26:
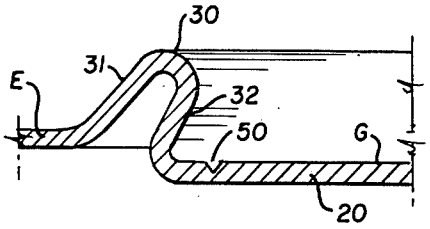
FIG. 26 is a fragmentary sectional view similar to FIG. 15 but with a pressure score at the upper surface thereof showing the first step of forming a frangible discontinuity compound score outlining the gate.
Figure 31:
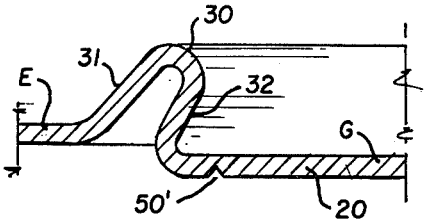
FIG. 31 is a fragmentary sectional view similar to FIG. 26, but with the pressure score at the under surface of the panel, to indicate another method for manufacture.
Figure 27:
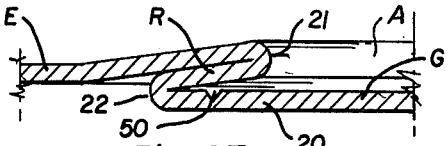
FIG. 27 is a fragmentary sectional view similar to FIG. 26, but with the ridge folded downwardly to form the underfold and aperture.
Figure 28:
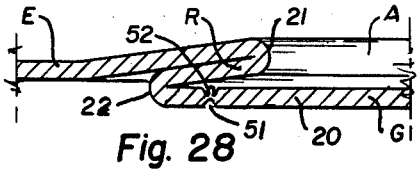
FIG. 28 is a fragmentary sectional view similar to FIG. 27 but with a pressure score at the under surface to complete the compound score.
Figure 29:
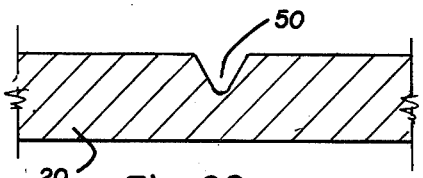
FIG. 29 is a greatly enlarged fragmentary sectional view of the pressure score at the upper surface of the panel as shown at FIG. 26.
Figure 34:
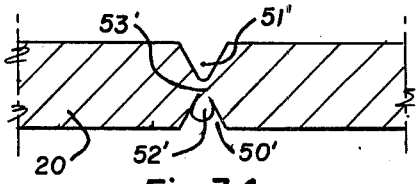
FIG. 34 is a greatly enlarged fragmentary sectional view of the compound score shown at FIG. 33.
Figure 30:
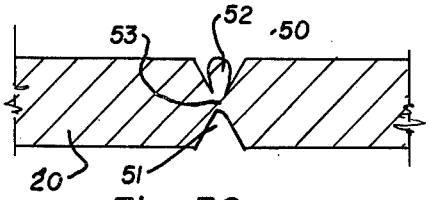
FIG. 30 is a fragmentary sectional view similar to FIG. 29, but showing, the opposing score, at the undersurface of the panel, completing the compound score.

FIGS. 26 to 30 illustrate the formation of a "compound score" which produces the frangible discontinuity outlining the gate. The aperture A and the gate panel 20 is prepared as heretofore described to the point where a score is cut in the panel 20, as at FIG. 26. However, instead of a shear offset 23, as heretofore described, a score 50 is impressed in the surface of the panel 20 to outline the gate G, as shown at FIG. 26. Next, the ridge 30 is folded upon the panel to form the aperture A and the inner fold 21 as shown at FIG. 27. Next, an opposing score 51 is impressed into the underside of the panel 20 opposite to the score 50. In so impressing this score 51 at the underside of the panel 20, a portion of the metal between the score 50 and the underside of the panel 20 is pushed upwardly into the score 50 to form a filler 52 as shown at FIG. 28. FIGS. 29 and 30 show enlarged views of the scores 50 and 51 as they appear in the panel 20 during the operations above described. It is to be noted that the neck 53 of continuous material of the filler 52 is comparatively narrow and that the metal at the neck is intensely worked by the shearing actions which occurs when the score 51 is pushed into the undersurface of the panel. Also, this metal is compressed as the scores 50 and 51 are formed and the metal at the neck 53 is under stress. Thus, it is easily ruptured. The depth of these scores 50 and 51 may be varied to the point where the gate is easily severed from the panel and opened by downward pressure.

Figure 32:
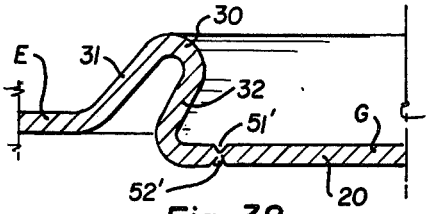
FIG. 32 is a fragmentary sectional view similar to FIG. 31, but with the opposite pressure score at the upper surface completing the compound score.
Figure 33:
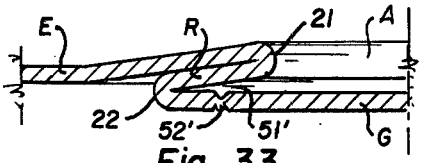
FIG. 33 is a fragmentary sectional view similar to FIG. 32, but with the ridge folded downwardly to form the underfold and aperture.

As above described, the compound score making up the frangible discontinuity outlining the gate may be partially formed before the ridge 30 is downfolded to form an aperture A and the inner fold 21 and subsequently, the compound shear is completed at the underside of the gate directing the filler 52 upwardly and against the intermediate rim R. This procedure may be reversed as in the manner illustrated at FIGS. 31–34 where a first score 55' is impressed at the underside of the panel 20. The subsequent step is to impress an opposing score 51' at the upper side of the panel pushing the filler 52' downwardly and in the initial score 50' as best illustrated at FIGS. 32 and 33. Again, the gate is secured to the panel by a very narrow neck 53' of metal which may be easily disrupted and broken. The final step is then to overfold the ridge 30 to form the aperture A and inner fold 30. It is to be noted that in forming this compound score, as mentioned in the other constructions herein described, the working and distortion of the metal, as described, impresses heavy stresses on the material which renders frangibility even more effective.

I have now described my invention in considerable detail. However, it is obvious that others skilled in the art can build and devise alternate and equivalent constructions and operations which are nevertheless within the spirit and scope of my invention. Hence, I desire that my protection be limited, not by the constructions and operations illustrated and described, but only by the proper scope of the appended claims.

What is claimed is:

1. A can end having a push-down gate below an aperture in the lid, and being formed as a unitary structure by drawing and shaping the flat sheet metal member forming the can lid, and comprising:

(a) the aforesaid aperture in the lid member;

(b) a comparatively narrow spacing rim underfolded about the edge of this aperture to lie below the undersurface of the lid member;

(c) a panel portion connecting with the outward peripheral edge of the spacing rim to lie thereunder, and to extend across the aperture, below the lid and rim to normally close the gate; and (d) a frangible discontinuity in the panel portion including the upper surface of the panel to define the outline of the aforesaid push-down gate, said frangible discontinuity being underneath the spacing rim and away from the edge of the aperture, whereby the exposed edge of the discontinuity formed when the gate is pushed downwardly to open the lid, will not be at the aperture, said frangible discontinuity comprising a replaced offset shear having sheared portions at both surfaces of the panel.

2. A can end having a push-down gate below an aperture in the lid, and being formed as a unitary structure by drawing and shaping the flat sheet metal member forming the can lid, and comprising:

(a) the aforesaid aperture in the lid member;

(b) a comparatively narrow spacing rim underfolded about the edge of this aperture to lie below the undersurface of the lid member;

(c) a panel portion connecting with the outward peripheral edge of the spacing rim to lie thereunder, and to extend across the aperture, below the lid and rim to normally close the gate; and (d) a frangible discontinuity in the panel portion including the upper surface of the panel to define the outline of the aforesaid push-down gate, said frangible discontinuity being underneath the spacing rim and away from the edge of the aperture, whereby the exposed edge of the discontinuity formed when the gate is pushed downwardly to open the lid, will not be at the aperture, said frangible discontinuity comprising a thin walled residual between two adjacent score cuts impressed in opposite faces of the panel.

3. The can end defined in claim 2, wherein the residual is normal to the plane of the panel.

4. A can end having a push-down gate below an aperture in the lid, and being formed as a unitary structure by drawing and shaping the flat sheet metal member forming the can lid, and comprising:

(a) the aforesaid aperture in the lid member;

(b) a comparatively narrow spacing rim underfolded about the edge of this aperture to lie below the undersurface of the lid member;

(c) a panel portion connecting with the outward peripheral edge of the spacing rim to lie thereunder, and to extend across the aperture, below the lid and rim to normally close the gate; and (d) a frangible discontinuity in the panel portion including the upper surface of the panel to define the outline of the aforesaid push-down gate, said frangible discontinuity being underneath the spacing rim and away from the edge of the aperture, whereby the exposed edge of the discontinuity formed when the gate is pushed downwardly to open the lid, will not be at the aperture, said frangible discontinuity comprising a compound score having a score cut in one face of the panel and the second core cut opposing the first, with the first score receiving excess material to the first mentioned score cut.

* * * * *